US008495897B1

(12) United States Patent
Koc

(10) Patent No.: US 8,495,897 B1
(45) Date of Patent: Jul. 30, 2013

(54) OVERHEAD DOOR LOCK

(76) Inventor: Thomas Koc, North Arlington, NJ (US)

( * ) Notice: Subject to any disclaimer, the term of this patent is extended or adjusted under 35 U.S.C. 154(b) by 223 days.

(21) Appl. No.: 12/860,869

(22) Filed: Aug. 21, 2010

(51) Int. Cl.
*E05B 65/08* (2006.01)
*E05B 65/48* (2006.01)
*E05C 1/02* (2006.01)

(52) U.S. Cl.
USPC ..... 70/95; 70/13; 292/1; 292/137; 292/148; 292/104; 292/205

(58) Field of Classification Search
USPC ..... 70/2, 3, 4, 5, 6, 7, 8, 9, 10, 11, 12, 70/13, 32, 33, 34, 95, 96, 97, 98, 99, 100, 70/DIG. 11; 292/1, 137, 138, 145, 150, DIG. 36; 49/197, 198, 449
See application file for complete search history.

(56) References Cited

U.S. PATENT DOCUMENTS

| | | | | | |
|---|---|---|---|---|---|
| 716,118 | A | * | 12/1902 | Scott | 292/1 |
| 1,113,667 | A | | 10/1914 | Mahaj | |
| 1,336,505 | A | * | 4/1920 | Buggeln | 292/1 |
| 2,124,970 | A | * | 7/1938 | Bagley | 292/40 |
| 2,564,600 | A | | 8/1951 | Hummer | |
| 2,917,335 | A | | 12/1959 | Pyka | |
| 3,599,453 | A | * | 8/1971 | Bauernfeind | 70/129 |
| 3,843,178 | A | | 10/1974 | Eskoff | |
| 4,080,757 | A | | 3/1978 | Westerman | |
| 4,520,591 | A | | 6/1985 | Calvagno | |
| D283,672 | S | * | 5/1986 | Greco | D8/331 |
| 4,747,629 | A | * | 5/1988 | Miller | 292/92 |
| 4,751,831 | A | * | 6/1988 | Morris et al. | 70/159 |
| 4,972,689 | A | * | 11/1990 | Anderson | 70/56 |
| 6,053,547 | A | | 4/2000 | Lemieux | |
| 6,915,670 | B2 | * | 7/2005 | Gogel | 70/32 |
| 7,047,774 | B1 | * | 5/2006 | Gogel | 70/32 |
| 7,232,163 | B2 | * | 6/2007 | Weselak | 292/292 |
| 7,726,704 | B1 | * | 6/2010 | Goldstein et al. | 292/1 |

FOREIGN PATENT DOCUMENTS

| | | |
|---|---|---|
| CN | 2916051 | 6/2007 |
| JP | 2006342539 | 12/2006 |
| WO | WO2009119986 | 10/2009 |

* cited by examiner

*Primary Examiner* — Christopher Boswell
*Assistant Examiner* — Duoni Pan
(74) *Attorney, Agent, or Firm* — Michael I. Kroll

(57) ABSTRACT

Disclosed is an overhead door lock with a mounting plate which mounts to a door header and has a locking aperture therein; a barricade with a bracket which fastens to a top of an overhead door and a faceplate affixed thereto, the faceplate having an aperture and a flange extending generally perpendicularly to the faceplate, the flange having an aperture; and a coupling sized to pass through the faceplate aperture and having a first end which affixes into the mounting plate locking aperture and a second end with an aperture positioned such that when the first end of the coupling is inserted through the faceplate aperture and affixed into the mounting plate locking aperture, the coupling aperture and the faceplate flange aperture are coaligned for inserting a locking device which prevents the overhead sliding door from being opened, either from the outside or inside.

8 Claims, 12 Drawing Sheets

OVERHEAD DOOR LOCK

BACKGROUND OF THE INVENTION

1. Field of the Invention

The present invention relates generally to door locks and, more specifically, to an overhead door lock comprising a mounting plate fastened to the door header and a face plate that can be optionally fastened to the top of the garage door wherethen a coupling is threadedly fastened through a face plate aperture and mounting plate aperture thereby enabling a lock to be inserted through a coupling aperture and a faceplate flange aperture.

2. Description of the Prior Art

There are other lock devices designed for overhead doors. Typical of these is U.S. Pat. No. 1,113,667 issued to Majah on Oct. 13, 1914.

Another patent was issued to Hummer on Aug. 14, 1951 as U.S. Pat. No. 2,564,600. Yet another U.S. Pat. No. 2,917,335 was issued to Pyka on Dec. 15, 1959 and still yet another was issued on Oct. 22, 1974 to Eskoff as U.S. Pat. No. 3,843,178.

Another patent was issued to Westerman on Mar. 28, 1978 as U.S. Pat. No. 4,080,757. Yet another U.S. Pat. No. 4,520,591 was issued to Calvagno on Jun. 4, 1985. Another was issued to Lemieux on Apr. 25, 2000 as U.S. Pat. No. 6,053,547 and still yet another was issued on Jul. 12, 2005 to Gogel as U.S. Pat. No. 6,915,670.

Another patent was issued to Kusakabe on Dec. 21, 2006 as Japanese Patent No. JP2006342539. Chinese Patent No. CH2916051 was issued to Wang on Jun. 27, 2007 and International Patent Application Publication No. WO2009/119986 was published to Sin on Oct. 1, 2009.

U.S. Pat. No. 1,113,667

Inventor: Stephen Mahaj

Issued: Oct. 13, 1914

A spring actuated bolt comprising a casing closed at one end and having longitudinal grooves upon its inner surface and aligning perforations through the closed end thereof, a cage provided with side bars longitudinally slidable within said grooves and through said perforations, a bolt carried by and slidable with said cage and resilient means within said cage engaging the casing at its closed end and the forward end of the cage to project said bolt.

U.S. Pat. No. 2,564,600

Inventor: Charles W. Hummer

Issued: Aug. 14, 1951

An automatic door safety lock for use on an automobile of the closed type provided with outwardly swinging doors and a roof, comprising a body member, means for fastening said body member to a free edge of said roof, a locking arm inclined inwardly in the direction of one of said doors and slidably engaging and pivoted to said body member and adapted to be swung downwardly to substantially a vertically extending position to engage one of said doors and prevent the opening thereof and means carried by said body member and positioned above said fastening means and exerting pressure against said roof and acting to resist pressure applied against said locking arm.

U.S. Pat. No. 2,917,335

Inventor: John P. Pyka

Issued: Dec. 15, 1959

A latch comprising: a projection to rotate about a predetermined axis perpendicular to its own longitudinal axis; bias means to hold said projection yieldingly in an inoperative rotational position about said predetermined axis; a bracket having a constraining member mounted thereon, said constraining member having a substantially frusto-conical surface of revolution, said constraining member having a hole approximately at the center of said frusto-conical surface to receive the free end of said projection; a catch member on the free end of said projection to engage a rearward surface of said constraining member; and release means to permit removal of said constraining member from said projection.

U.S. Pat. No. 3,843,173

Inventor: Alexander Eskoff

Issued: Oct. 22, 1974

An overhead hand operated door lock intended for use with a sliding overhead garage type door having a bracket adapted for mounting to the door frame above the top edge of the door with a separate locking plate adapted to be removably mounted onto a projecting end of the bracket in a position adjacent a top edge portion of the door in a manner adapted to engage the top portion of the door to prevent the same from being opened from a closed vertical position to an opened horizontal position.

U.S. Pat. No. 4,080,757

Inventor: Floyd Westerman

Issued: Mar. 28, 1978

The invention relates to a safety latch assembly for a warehouse type door that has rollers riding in a vertical guide track, such track having latching holes at various points along its length. The latch assembly has a latch pin with a roller end spring biased toward the track, and rides on the track with the door until it comes into latching engagement with one of the aforementioned holes, and locks the door into its current position. Withdrawing the latch pin from the hole resets the bias spring as the door becomes unlocked.

U.S. Pat. No. 4,520,591

Inventor: Michael J. Calvagno

Issued: Jun. 4, 1985

A safety lock assembly for use with a garage door to prevent the latter from falling uncontrollably in the event the counterweight system supporting the garage door fails. The invention has a pivoted arm biased into a position blocking door movement. The counterweight system is attached to the pivoted arm to overcome the bias. In the event of a failure in the weight supporting members, the built-in bias will move the arm into its position where further significant movement of the door is prevented.

U.S. Pat. No. 6,053,547

Inventor: Armand Lemieux

Issued: Apr. 25, 2000

A sliding door locking device is used to lock a sliding door, such as an overhead sliding door used in garages, storage trailers and the like. The sliding door locking device includes a door mounting member that is positioned over an edge or top portion of the sliding door and a movement restricting member that locks to the door mounting member and abuts a structural support to restrict movement of the sliding door. One example of the door mounting member includes a locking pin and a locking ring. The movement restricting member includes a locking slot for receiving and locking with the locking pin and a hasp having an aperture for receiving the locking ring. A padlock or other locking mechanism is inserted through the locking ring to lock the movement restricting member to the door mounting member. The sliding door locking device thus provides a secondary lock that locks the sliding door from the outside without having to be permanently mounted to the door or other structure.

U.S. Pat. No. 6,915,670

Inventor: Roy E. Gogel

Issued: Jul. 12, 2005

A security device is provided which may be installed on a roll-up door of a cargo container garage or storage facility. The security device includes a locking bar having a locking pin, which is shiftable into a locking pin receiving aperture in a side wall of the roll-up doorframe. The locking bar also includes a tab with an opening for receiving the locking rod of a puck shaped lock when the locking bar is in the locking position.

Japan Patent Number JP2006342539

Inventor: Naoki Kusakabe

Issued: Dec. 21, 2006

PROBLEM TO BE SOLVED: To provide a door opening preventing device for preventing a child from unlocking a door by mischief.

SOLUTION: A first base part and a second base part are installed straddlingly the door stops of doors, connected to each other through an arm part, and double-locked by a first lock means having, on the first base part, a locking projected part projected and recessed toward the arm part and a second lock means having a locking claw projected and recessed toward a guide groove.

China Patent Number CN2916051

Inventor: Longtian Wang

Issued: Jun. 27, 2007

A door stop belongs to the class of nails. The utility model is composed of a strike, an apron plate and an apron plate bearing and is characterized in that the apron plate presents a rectangle bar shape and one end is bent into a right-angled shape to make the apron plate divided into long and short two parts. A short end of the apron plate is provided with a strike cavity. The apron plate bearing presents a square figure and is provided with a fastener groove, which can make the long end of the apron plate penetrate the fastener groove with jointing. When the utility model is used, the strike can be fixed on the door frame and the apron plate bearing can be fixed at the external end of a concealed lock on the door, which can make the long end of the apron plate penetrate the apron plate bearing. The apron plate is pushed towards the direction of the door frame after the door is locked to make the strike penetrate out from the strike cavity on the apron plate and then a lock is added in to implement fixation. This door stop equals to being additionally provided with a lock again and can prevent the lock eye from being damaged. The utility model is designed reasonably and can be used conveniently.

International Patent Application Publication No. WO2009/119986

Inventor: Jae-Hyoek Sin

Issued: Oct. 1, 2009

The present invention concerns a forced entry preventive anchoring apparatus for a sliding door. It is attached to a side of a sliding door frame and by friction of an anchoring apparatus prevents the locked sliding door in a certain position from being forced or arbitrarily opened. Therefore, the disclosed apparatus may be used for crime prevention or children's safety. The present invention comprises an anchoring main body wherein an operating space angled in relation to the bottom surface thereof is formed in the longitudinal direction, an operating block whereof an operating groove is upwardly opened in the center and a frictional member is attached to the bottom, and an operating lever. In the operating space of the anchoring main body, the operating block is inserted so that the frictional member can protrude through a connection space. The operating lever is placed in a manipulation space while an operating arm is inserted in the operating groove and the operating lever is fastened to a base piece by inserting a base pin into both a hole formed in the base piece and a base hole. Both ends of an elastic member are respectively connected to the anchoring main body and a connection hole.

While these door fasteners may be suitable for the purposes for which they were designed, they would not be as suitable for the purposes of the present invention, as hereinafter described.

SUMMARY OF THE PRESENT INVENTION

A primary object of the present invention is to provide an overhead door lock that prevents the door from being opened from the interior side or exterior side of the overhead door.

Another object of the present invention is to provide an overhead door lock comprising a mounting plate and a face plate.

Yet another object of the present invention is to provide an overhead door lock further comprising a face plate flange and coupler.

Still yet another object of the present invention is to provide an overhead door lock wherein said mounting plate as a plurality of apertures for mounting to the door header.

Another object of the present invention is to provide an overhead door lock wherein said face plate can optionally be mounted to the top of a door.

Yet another object of the present invention is to provide an overhead door lock wherein said mounting plate and said face plate have co-aligned aperture for receiving a threaded coupler.

Still yet another object of the present invention is to provide an overhead door lock wherein said coupler and said face plate flange have co-aligned aperture for inserting a lock therethrough.

Additional objects of the present invention will appear as the description proceeds.

The present invention overcomes the shortcomings of the prior art by providing an overhead door lock comprising a mounting plate fastened to the door header and a face plate that can be optionally fastened to the top of the garage door wherethen a coupling is threadedly fastened through a face plate aperture and mounting plate aperture thereby enabling a lock to be inserted through a coupling aperture and a faceplate flange aperture.

The foregoing and other objects and advantages will appear from the description to follow. In the description reference is made to the accompanying drawing figures, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 a perspective view of the present invention in use.

FIG. 2 an illustrative view of the present invention.

FIG. 3 a perspective assembly view of the present invention.

FIG. 4 a perspective assembly view of the present invention.

DESCRIPTION OF THE REFERENCED NUMERALS

Figure 1:
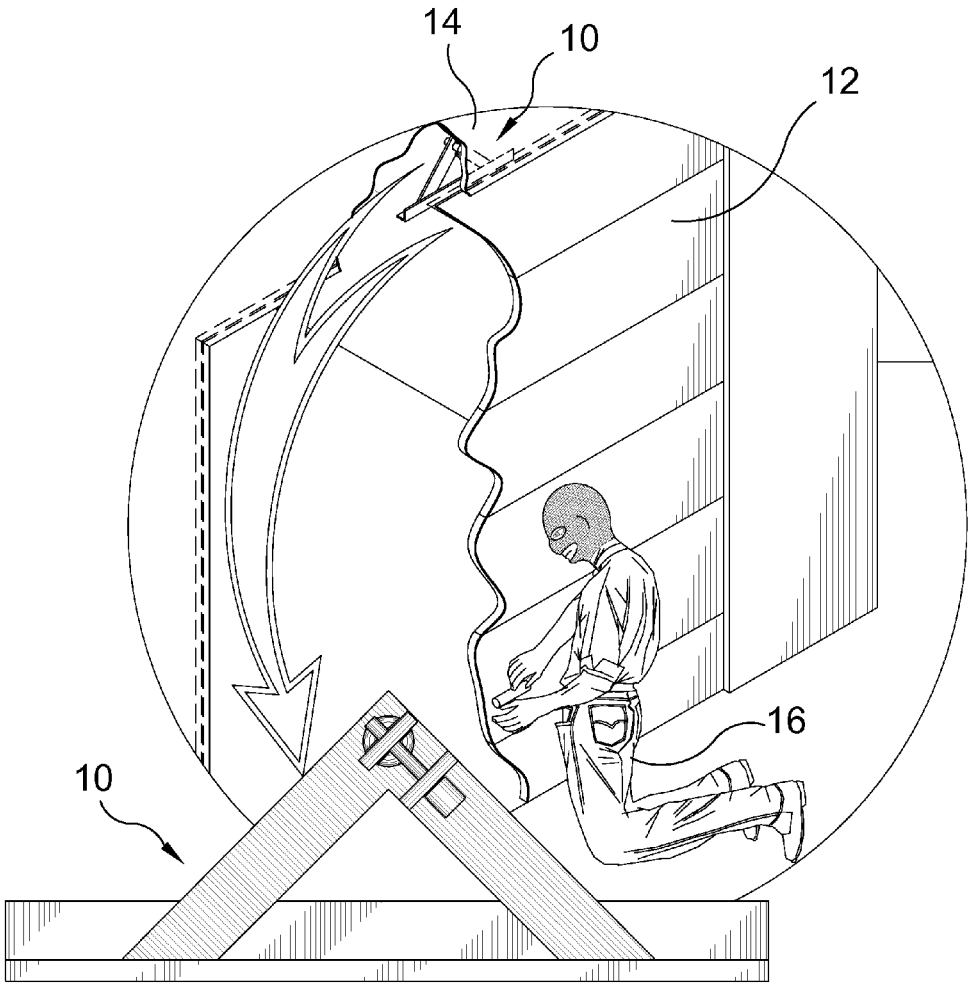

Turning now descriptively to the drawings, in which similar reference characters denote similar elements throughout the several views, the figures illustrate the Overhead Door Lock of the present invention. With regard to the reference numerals used, the following numbering is used throughout the various drawing figures.

| | |
|---|---|
| 10 | Overhead Door Lock of the present invention |
| 12 | door |
| 14 | door header |
| 16 | burglar |
| 18 | mounting plate |
| 20 | barricade |
| 22 | coupling |
| 24 | mounting apertures in 18 |
| 26 | screws |
| 28 | mounting plate locking aperture |
| 30 | bracket |
| 32 | faceplate |
| 34 | faceplate aperture |
| 36 | faceplate flange |
| 38 | faceplate flange aperture |
| 40 | coupling aperture |
| 42 | locking device |
| 44 | first end of coupling |
| 46 | second end of coupling |
| 48 | right angle longitudinal bend in 30 |
| 50 | lower portion of 30 |
| 52 | upper portion of 30 |
| 54 | apertures in 50 |
| 56 | padlock |
| 58 | garage |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 a perspective view of the present invention in use. Shown is the present invention being an overhead door lock 10 for vertically opening garage or sliding doors 12. The overhead door lock 10 of the present invention essentially affixes the movable door 12 to the immovable door header 14 in order to block the door's 12 vertical progression, effectively barricading the door 12 shut, preventing unauthorized opening of the door 12, for example, by a burglar 16. The overhead door lock 10 is effective in preventing the door from opening both from outside or from inside.

Figure 2:
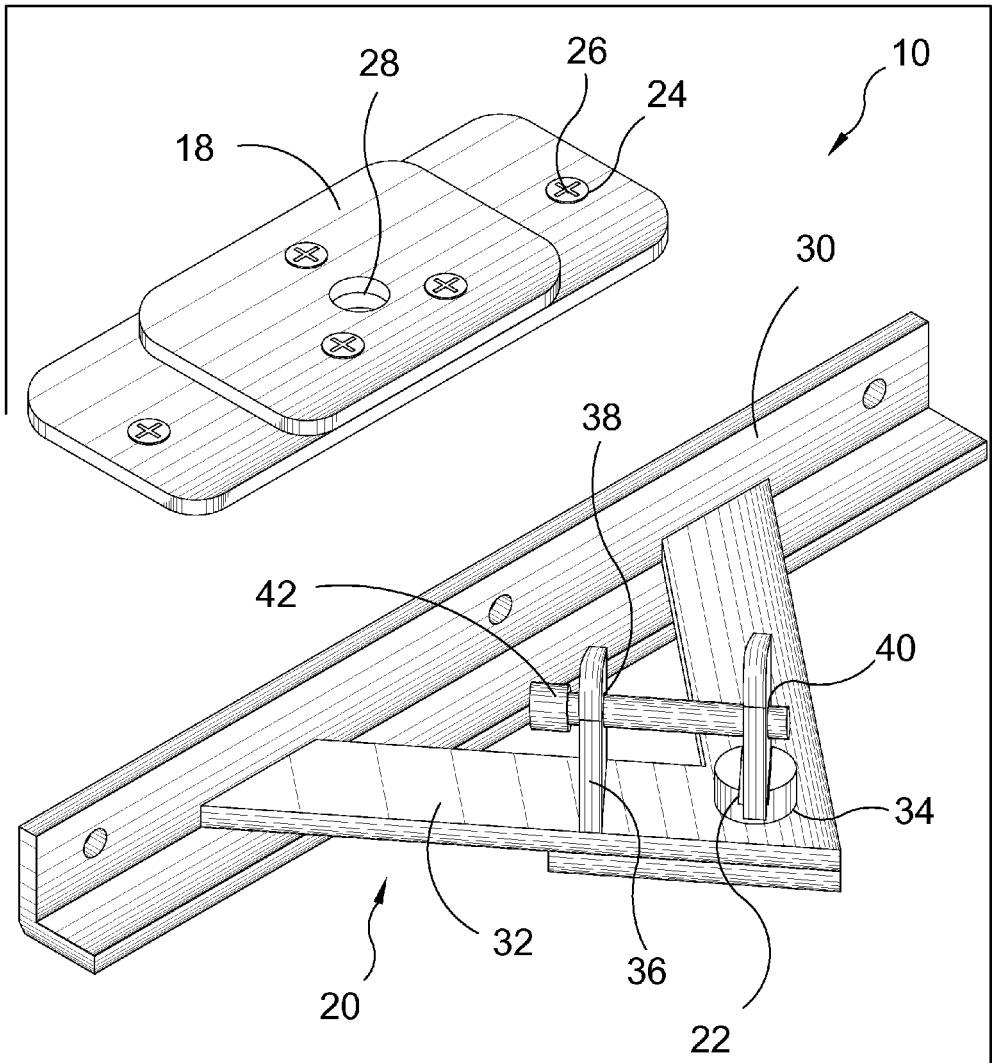

FIG. 2 an illustrative view of the present invention. Shown is the present invention comprising an overhead door lock 10 having a mounting plate 18, a barricade 20, and a coupling 22. The mounting plate 18 is adapted to mount to a door header, for example with a plurality of mounting apertures 24 through which screws 26 or other fasteners can be driven into the door header above the sliding door. The mounting plate 18 also has a locking aperture 28 therein, to which the door is indirectly affixed. The barricade 20 has a bracket 30 adapted to fasten to a top of the door and a faceplate 32 affixed to the bracket 30. The faceplate 32 has an aperture 34 therethrough and a flange 36 extending generally perpendicularly, and the flange 36 has an aperture 38 therethrough. The coupling 22 is sized to pass through the faceplate aperture 34 and has a first end adapted to affix into the mounting plate locking aperture 28 and a second end having an aperture 40 positioned such that when the coupling 22 is inserted through the faceplate aperture 34 and affixed into the mounting plate locking aperture 28, the coupling aperture 40 and the faceplate flange aperture 38 are generally coaligned. To use the device the user mounts the mounting plate 18 above the door's upper interior threshold in a permanent location. When barricading of the door is desired the faceplate 32 is coupled to the mounting plate 18 via the coupling 22 and a locking device 42, for example, a pin, is placed through the faceplate flange aperture 38 and the coupling aperture 40, thus preventing removal of the coupling 22 and movement of the door from a closed position.

Figure 3:
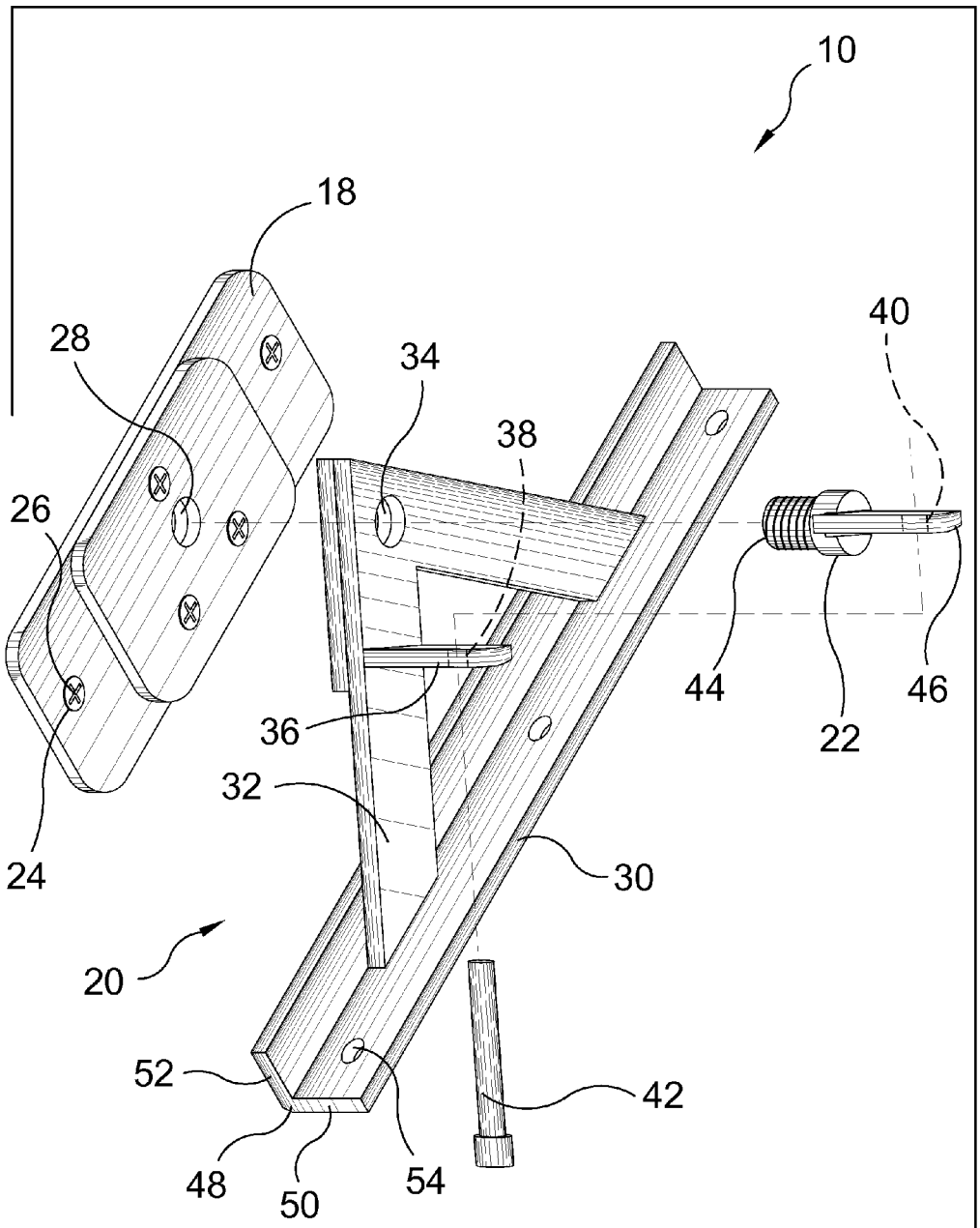

FIG. 3 a perspective assembly view of the present invention. The present invention provides an overhead door lock 10 having a mounting plate 18, a barricade 20, and a coupling 22. The mounting plate 18 is adapted to mount to a door header, for example with a plurality of mounting apertures 24 through which screws 26 or other fasteners can be driven into the door header above the sliding door. The mounting plate 18 also has a locking aperture 28 therein, to which the door is indirectly affixed. The barricade 20 has a bracket 30 adapted to fasten to a top of the door and a faceplate 32 affixed to the bracket 30. The faceplate 32 has an aperture 34 therethrough and a flange 36 extending generally perpendicularly, and the flange 36 has an aperture 38 therethrough. The coupling 22 is sized to pass through the faceplate aperture 34 and has a first end 44 adapted to affix into the mounting plate locking aperture 28 and a second end 46 having an aperture 40 positioned such that when the coupling 22 is inserted through the faceplate aperture 34 and affixed into the mounting plate locking aperture 28, the coupling aperture 40 and the faceplate flange aperture 38 are generally coaligned. To use the device the user mounts the mounting plate 18 above the door's upper interior threshold in a permanent location. When barricading of the door is desired the faceplate 32 is coupled to the mounting plate 18 via the coupling 22 and a locking device 42, for example a pin, is placed through the faceplate flange aperture 38 and the coupling aperture 40, thus preventing removal of the coupling 22 and movement of the door from a closed position. As shown, the mounting plate locking aperture 28 and the first end 44 of the coupling 22 preferably have mating threads. Preferably, the bracket 30 comprises a generally flat elongate structure with a generally right angle longitudinal bend 48 forming a lower portion 50 for fastening to a top of an overhead door and an upper portion 52 for supporting the faceplate 32. The faceplate 32 is preferably affixed to and generally coplanar with the upper portion 52 of the bracket 30, with the lower portion 50 of the bracket 30 having a plurality of apertures 54 for fastening to the top of the overhead door.

Figure 4:
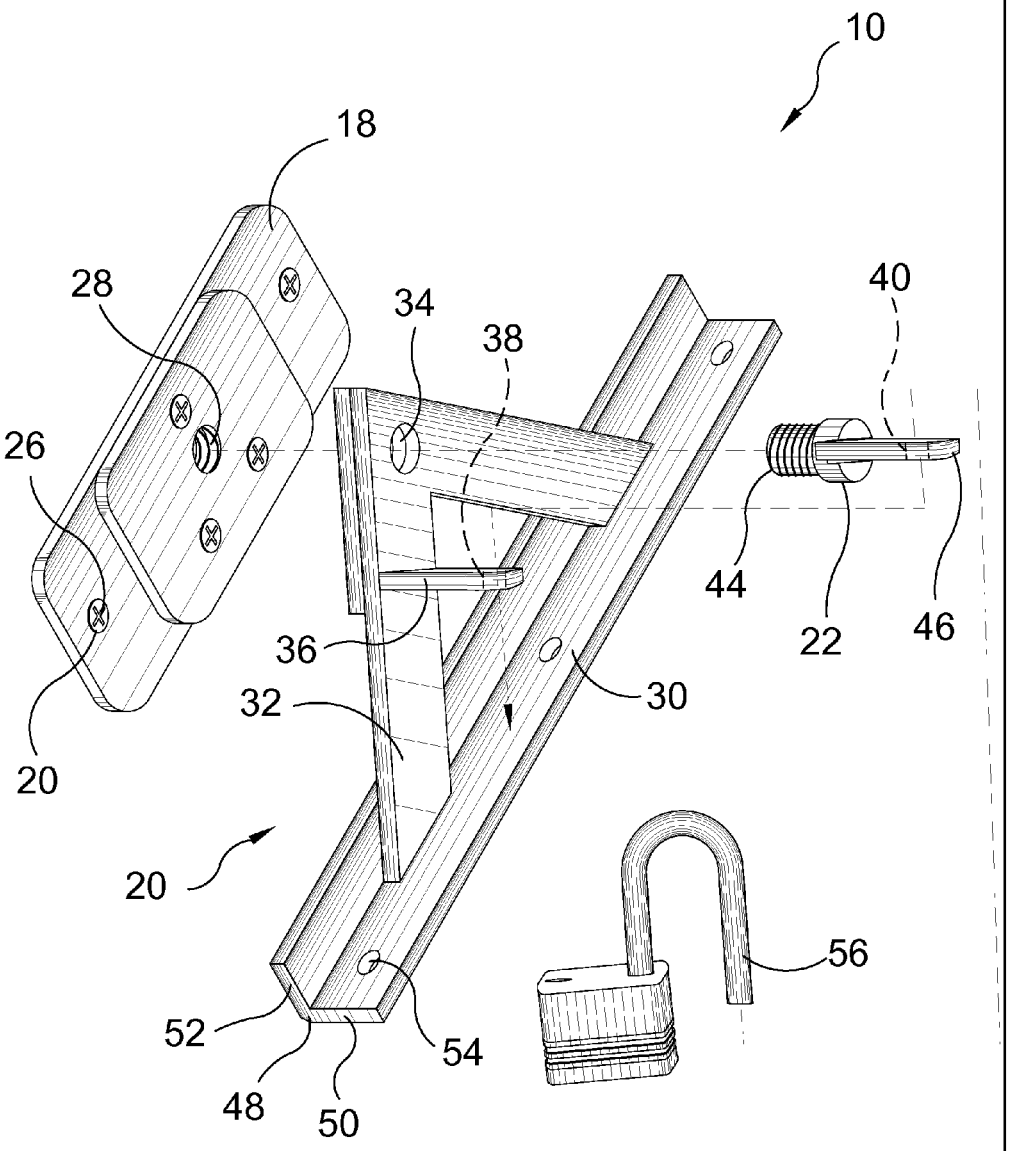

FIG. 4 a perspective assembly view of the present invention. The present invention provides an overhead door lock 10 having a mounting plate 18, a barricade 20, and a coupling 22. The mounting plate 18 is adapted to mount to a door header, for example with a plurality of mounting apertures 24 through which screws 26 or other fasteners can be driven into the door header above the sliding door. The mounting plate 18 also has a locking aperture 28 therein, to which the door is indirectly affixed. The barricade 20 has a bracket 30 adapted to fasten to a top of the door and a faceplate 32 affixed to the bracket 30. The faceplate 32 has an aperture 34 therethrough and a flange 36 extending generally perpendicularly, and the flange 36 has an aperture 38 therethrough. The coupling 22 is sized to pass through the faceplate aperture 34 and has a first end 44 adapted to affix into the mounting plate locking aperture 28 and a second end 46 having an aperture 40 positioned such that when the coupling 22 is inserted through the faceplate aperture 34 and affixed into the mounting plate locking aperture 28, the coupling aperture 40 and the faceplate flange aperture 38 are generally coaligned. To use the device the user mounts the mounting plate 18 above the door's upper interior threshold in a permanent location. When barricading of the door is desired the faceplate 32 is coupled to the mounting plate 18 via the coupling 22 and a locking device, for example a padlock 56, is placed through the faceplate flange aperture 38 and the coupling aperture 40, thus preventing removal of the coupling 22 and movement of the door from a closed position. As shown, the mounting plate locking aperture 28 and the first end 44 of the coupling 22 preferably have mating threads. Preferably, the bracket 30 comprises a generally flat elongate structure with a generally right angle longitudinal bend 48 forming a lower portion 50 for fastening to a top of an overhead door and an upper portion 52 for supporting the faceplate 32. The faceplate 32 is preferably affixed to and generally coplanar with the upper portion 52 of the bracket 30, with the lower portion 50 of the bracket 30 having a plurality of apertures 54 for fastening to the top of the overhead door.

Figure 5:
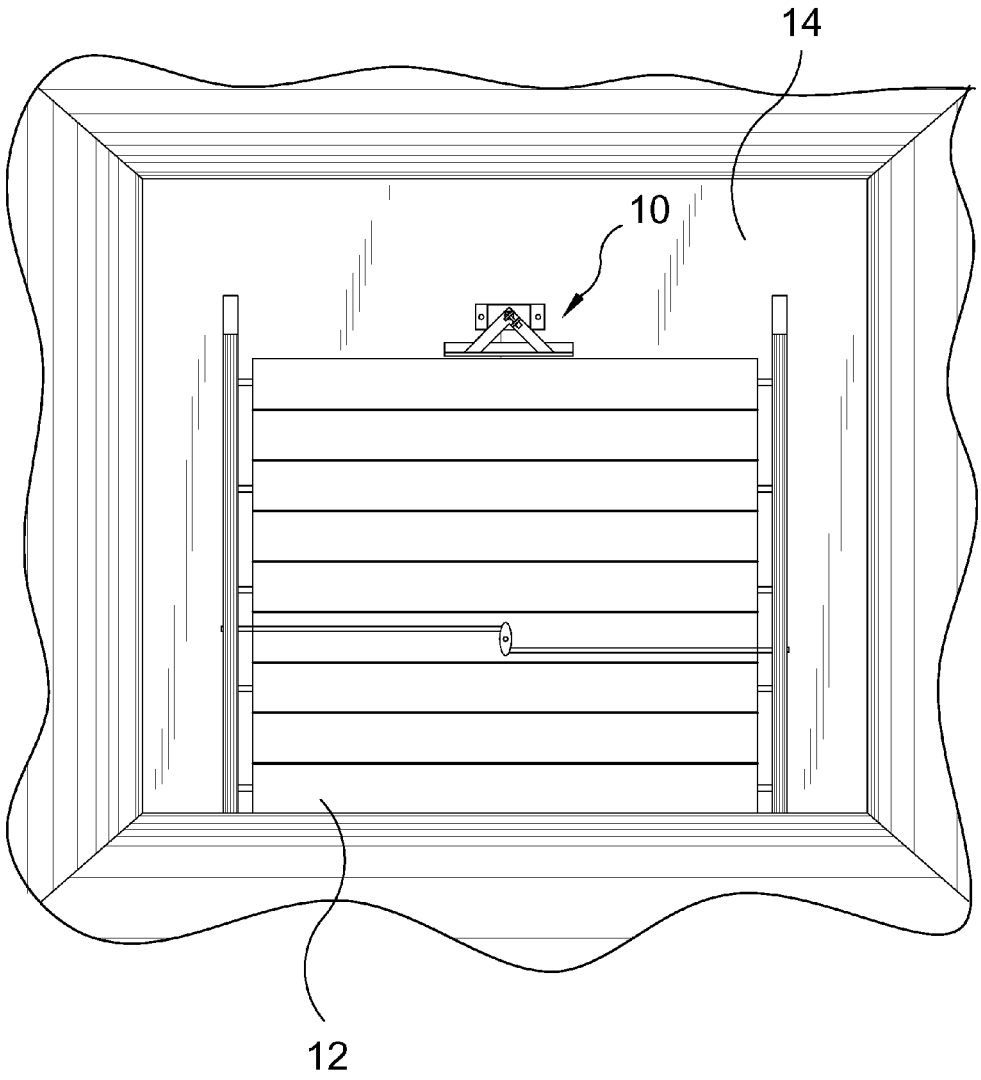
FIG. 5 is a perspective view of the present invention in use.

FIG. 5 is a perspective view of the present invention in use. Shown is the invention comprising an overhead door lock 10 for vertically opening garage or sliding doors 12. The overhead door lock 10 of the present invention essentially affixes the movable door 12 to the immovable door header 14 in order to block the door's 12 vertical progression, effectively barricading the door 12 shut, preventing unauthorized opening of the door 12. The overhead door lock 10 is effective in preventing the door from opening both from outside or from inside.

Figure 6:
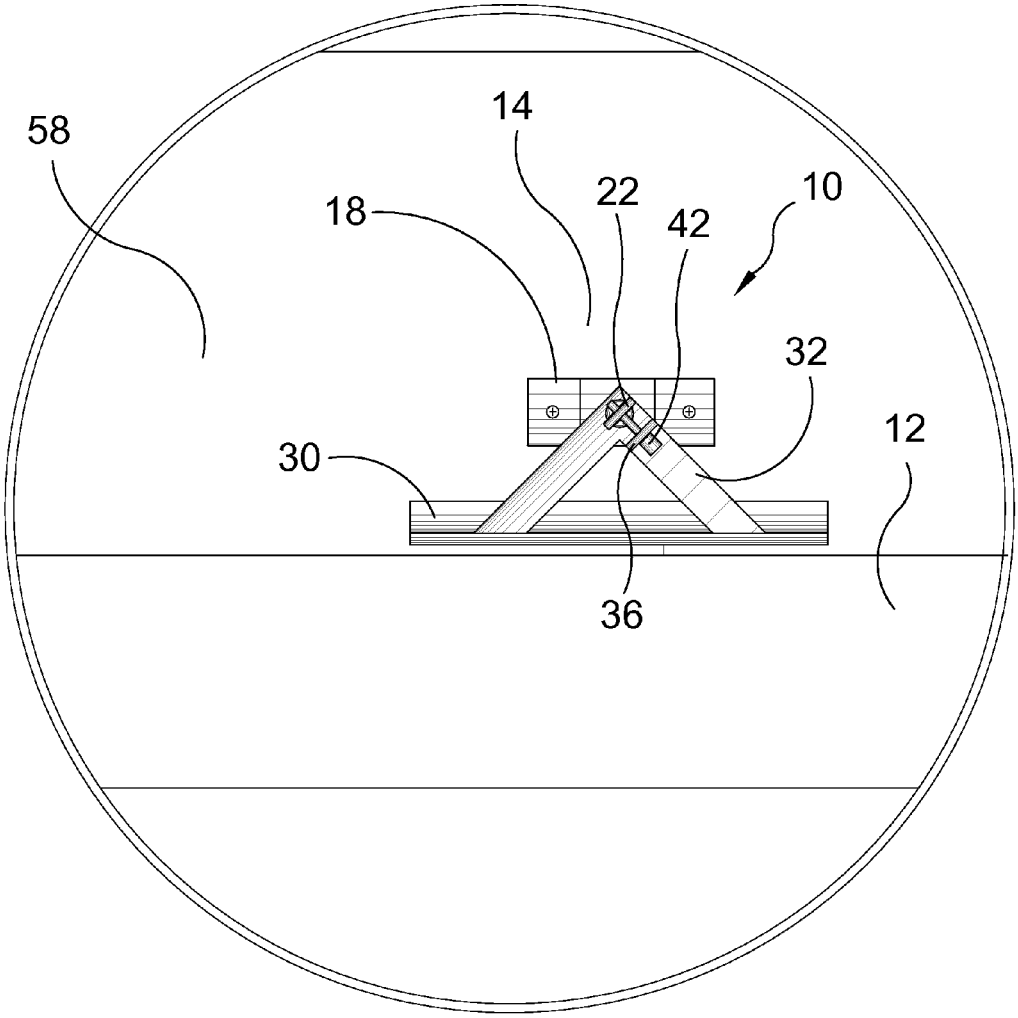
FIG. 6 is a detailed inside view of the present invention in use.

FIG. 6 is a detailed inside view of the present invention in use in a garage 58. Shown is an enlarged view of the overhead door lock 10 comprising a mounting plate 18 fastened to the door header 14 and a face plate 32 that can be optionally fastened to the top of the garage door 12 wherethen a coupling 22 is threadedly fastened through the face plate 32 and mounting plate 18 thereby enabling a locking device 42 to be inserted through the coupling 22 and faceplate flange 36 wherethen the bracket 30 will block the door's 12 vertical progression, effectively barricading the door 12.

Figure 7:
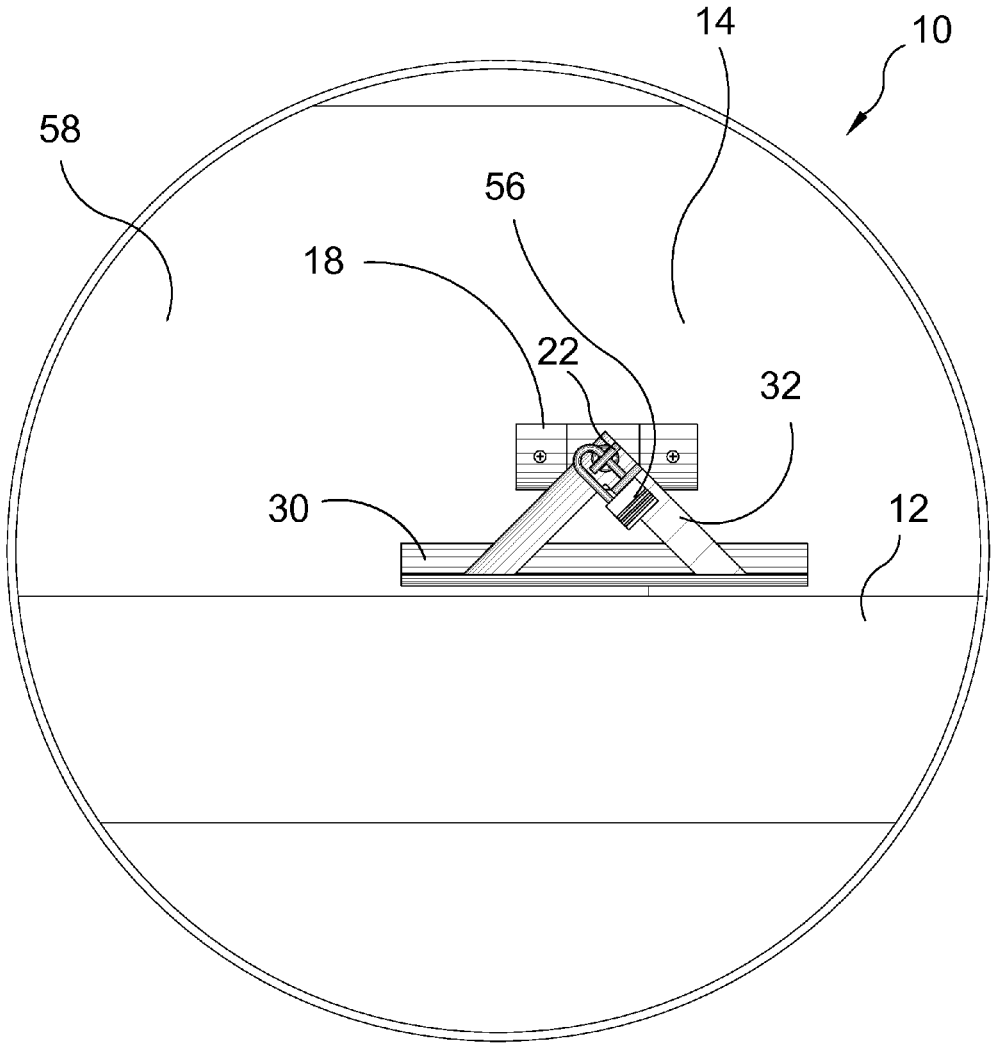
FIG. 7 is a detailed inside view of the present invention in use.

FIG. 7 is a detailed inside view of the present invention in use in a garage 58. Shown is an enlarged view of the overhead door lock 10 comprising a mounting plate 18 fastened to the door header 14 and a face plate 32 that can be optionally fastened to the top of the garage door 12 wherethen a coupling 22 is threadedly fastened through the face plate 32 and mounting plate 18 thereby enabling a locking device, such as a padlock 56 to be inserted through the coupling 22 and faceplate flange 36 wherethen the bracket 30 will block the door's 12 vertical progression, effectively barricading the door 12.

Figure 8:
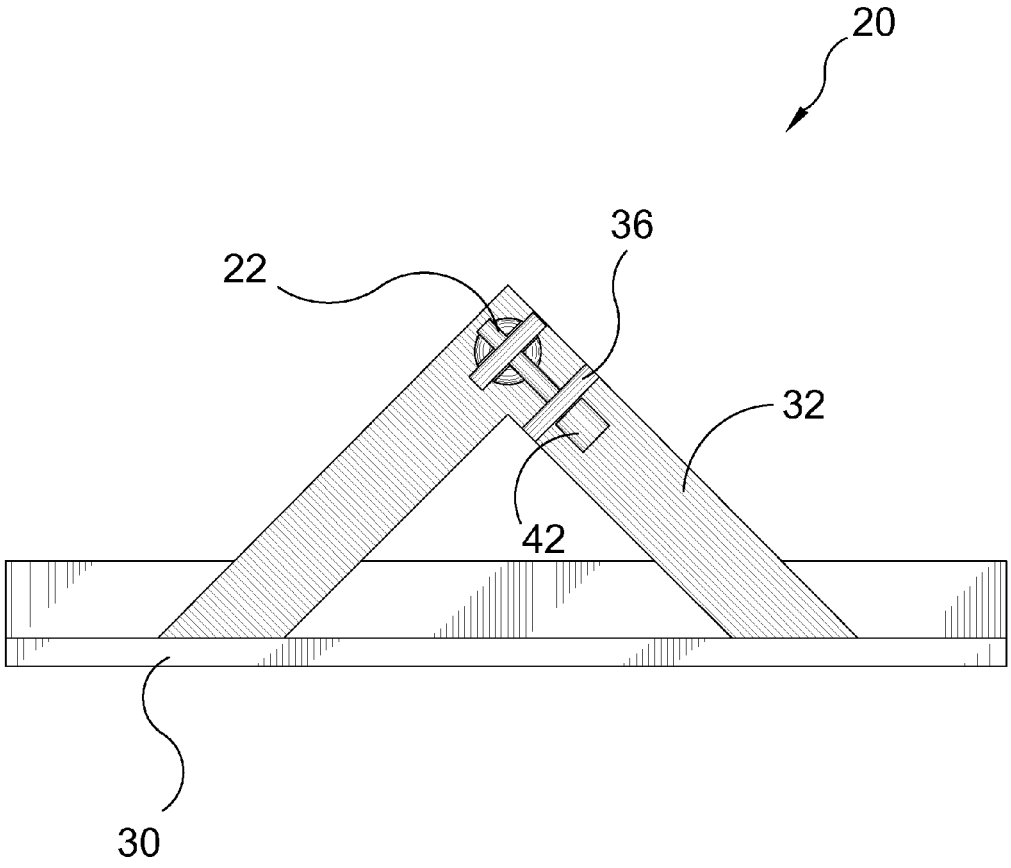
FIG. 8 is a front view of the face plate of the present invention.

FIG. 8 is a front view of the barricade 20 of the present invention in use, including the bracket 30 and faceplate 32 that can be optionally fastened to the top of the garage door wherethen a coupling 22 is threadedly fastened through the faceplate 32 thereby enabling a locking device 42 to be inserted through the coupling 22 and faceplate flange 36 wherethen the bracket 30 will block the door's vertical progression, effectively barricading the door in a closed position.

Figure 9:
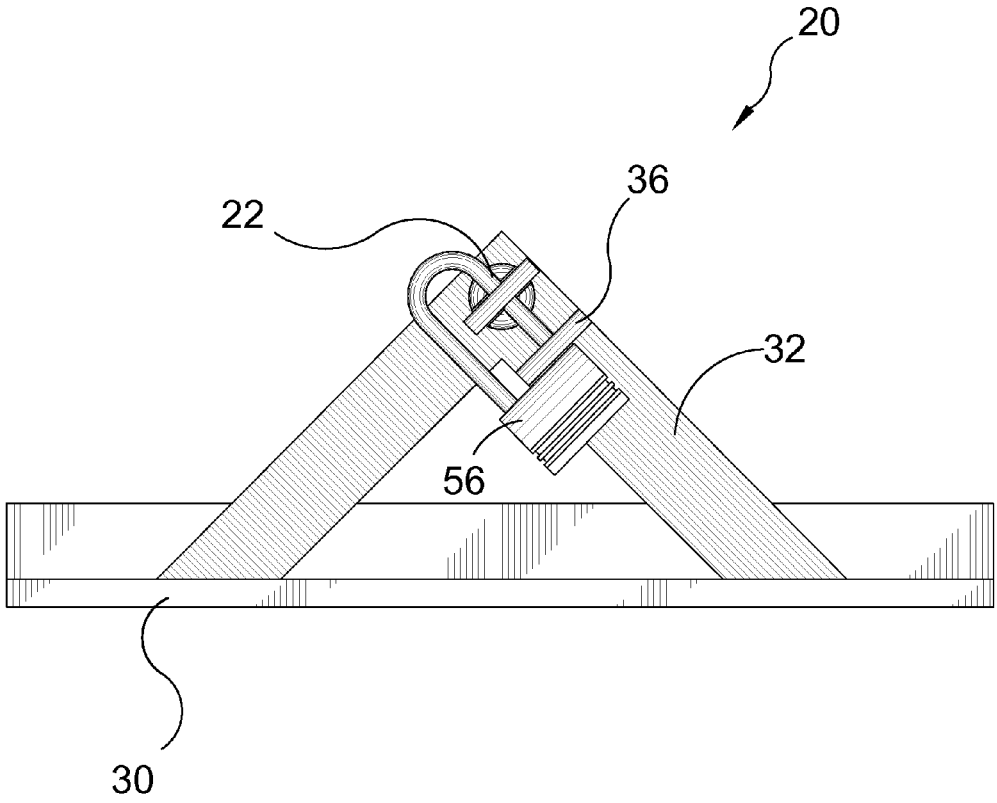
FIG. 9 is a front view of the face plate of the present invention.

FIG. 9 is a front view of the barricade 20 of the present invention in use, including the bracket 30 and faceplate 32 that can be optionally fastened to the top of the garage door wherethen a coupling 22 is threadedly fastened through the faceplate 32 thereby enabling a locking device, for example, a padlock 56 to be inserted through the coupling 22 and faceplate flange 36 wherethen the bracket 30 will block the door's vertical progression, effectively barricading the door in a closed position.

Figure 10:
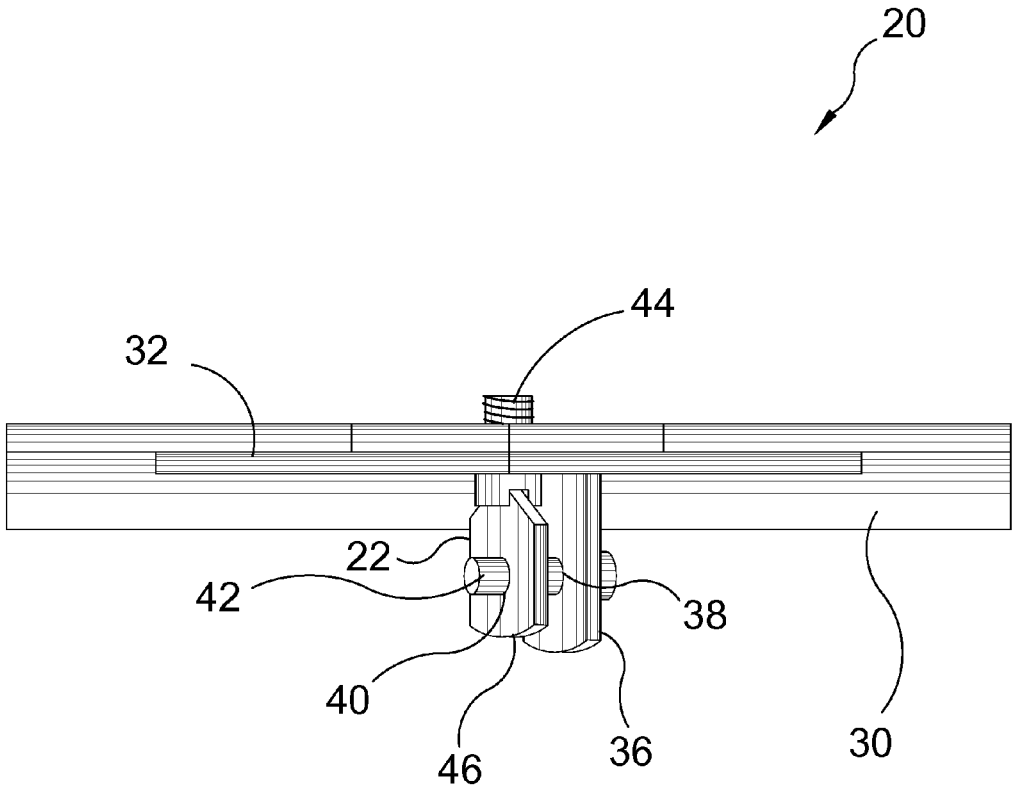
FIG. 10 is a top view of the overhead door lock of present invention.

FIG. 10 is a top view of the overhead door lock of present invention. Shown is the barricade 20 and coupling 22 secured by a pin as a locking device 42. The barricade 20 has a bracket 30 adapted to fasten to a top of the door and a faceplate 32 affixed to the bracket 30. The faceplate 32 has a flange 36 extending generally perpendicularly, and the flange 36 has an aperture 38 therethrough. The coupling 22 is sized to pass through an aperture in the faceplate 32 and has a threaded first end 44 and a second end 46 having an aperture 40 positioned such that when the coupling 22 is inserted through the faceplate and affixed to the mounting plate, the coupling aperture 40 and the faceplate flange aperture 38 are generally coaligned. When barricading of the door is desired a locking device 42 is placed through the faceplate flange aperture 38 and the coupling aperture 40, thus preventing removal of the coupling 22 and movement of the door from a closed position.

Figure 11:
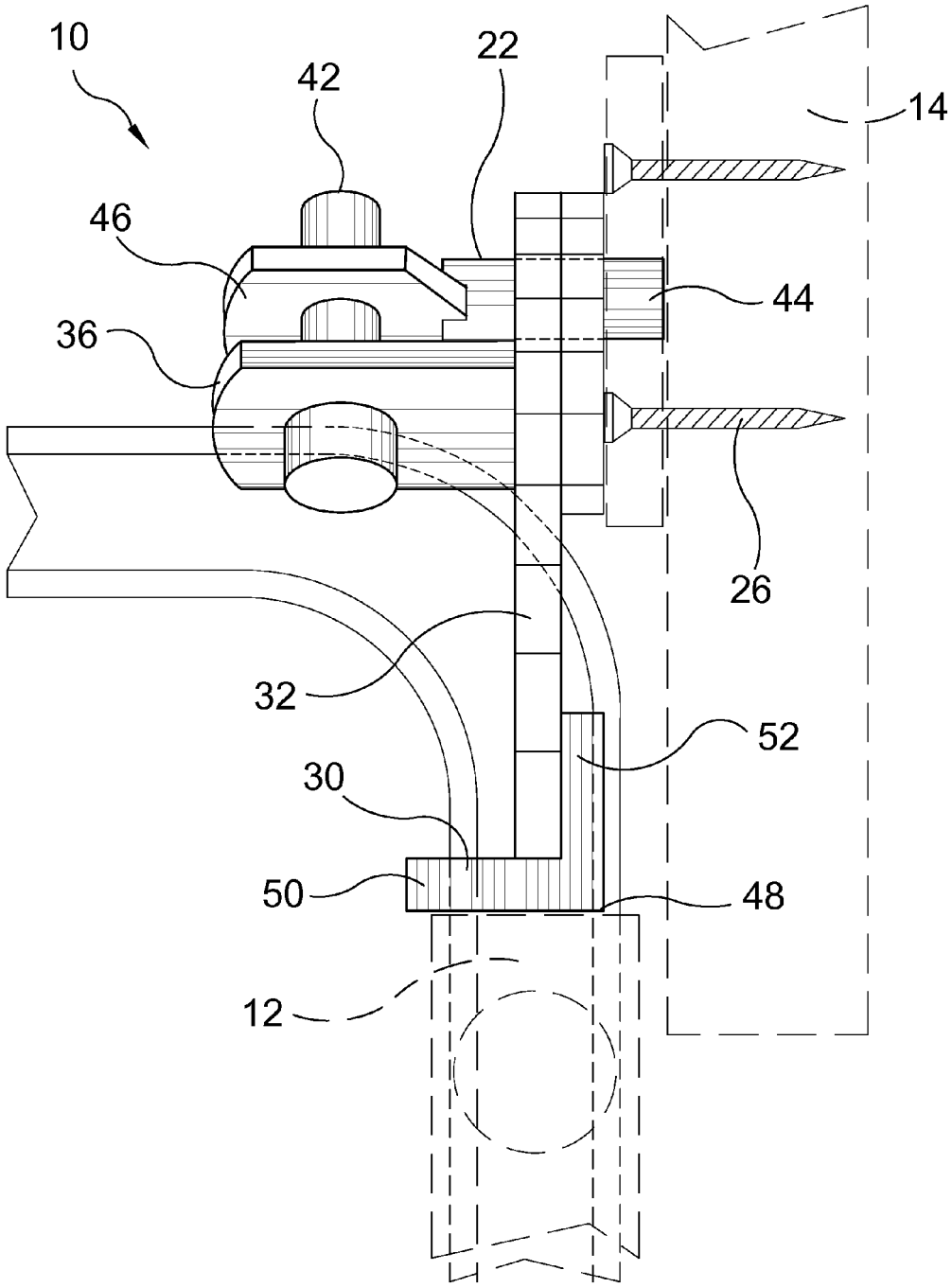
FIG. 11 is a side view of the present invention.

FIG. 11 is a side view of the present invention. Shown is the overhead door lock 10 having a mounting plate 18, a bracket 30 adapted to fasten to a top of the door 12, a faceplate 32 affixed to the bracket 30, a coupling 22, and a locking device 42. The mounting plate 18 mounts to the door header with a plurality of mounting screws 26 driven into the door header 14 above the sliding door 12. The faceplate 32 has a flange 36 extending generally perpendicularly. The coupling 22 is sized to pass through the faceplate 32 and has a first end 44 adapted to affix into the mounting plate 18 and a second end 46 positioned such that when the coupling 22 is inserted through the faceplate 32 and affixed into the mounting plate 18, the coupling aperture and the faceplate flange aperture are generally coaligned. To use the device the user mounts the mounting plate 18 into the door header 14 above the door's upper interior threshold in a permanent location. When barricading of the door is desired the faceplate 32 is coupled to the mounting plate 18 via the coupling 22 and a locking device 42, is placed through the faceplate flange 36 aperture and the coupling 22 aperture, thus preventing removal of the coupling 22 and movement of the door 12 from a closed position. Preferably, the bracket 30 comprises a generally flat elongate structure with a generally right angle longitudinal bend 48 forming a lower portion 50 for fastening to a top of an overhead door 12, for example, by a plurality of screws, and an upper portion 52 for supporting the faceplate 32. The faceplate 32 is preferably affixed to and generally coplanar with the upper portion 52 of the bracket 30.

Figure 12:
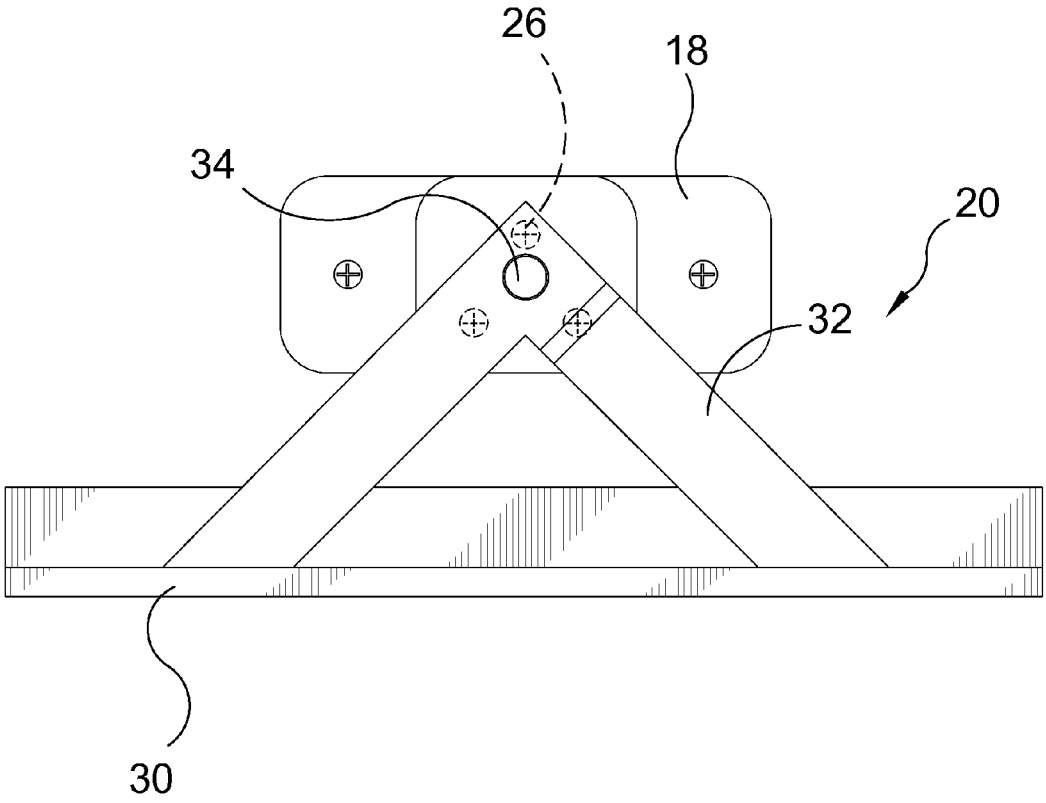
FIG. 12 is a front view of the face plate of the present invention.

FIG. 12 is a front view of the face plate of the present invention. Shown is the mounting plate 18 and barricade 20 of the present invention in use, including the bracket 30 and faceplate 32 that can be optionally fastened to the top of the garage door. The mounting plate 18 is permanently affixed to the door header, for example, with screws 26, such that the mounting plate locking aperture and the faceplate aperture 34 are aligned when the door is in the closed position, which allows a coupling which is inserted through the mounting plate locking aperture and the faceplate aperture 34 to prevent the door from being opened. Preferably, the faceplate 32 covers at least one or more of the mounting screws 26 when the overhead sliding door is closed, thus preventing removal of the mounting screws 26 when the door is locked.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. An overhead door lock comprising:

a) a mounting plate mounted on an overhead door header inside of a garage, said mounting plate having a locking aperture therein;

b) a barricade having an L-shaped bracket with one leg fastened to a top surface of an upper edge of an overhead sliding garage door and a faceplate affixed to an upwardly extending second leg of said bracket, said faceplate having an aperture therethrough and a flange mounted thereon extending generally perpendicularly to said faceplate, said flange having an aperture therethrough, said faceplate comprising a pair of legs joined at one end where said faceplate aperture is located, opposite ends of said legs being attached to said upwardly extending second leg of said bracket, said garage door being mounted so that when said garage door is in a closed position said faceplate is flush against said mounting plate with said aperture in said faceplate aligned with said locking aperture of said mounting plate, and when said garage door is opened said faceplate moves away from said mounting plate in a direction perpendicular to said faceplate;

c) a coupling passing through said faceplate aperture and having a first end affixed into said mounting plate locking aperture when said garage door is closed and a second end having an aperture positioned such that when said first end of said coupling is inserted through said faceplate aperture and affixed into said mounting plate locking aperture, said coupling aperture and said faceplate flange aperture are generally coaligned; and d) a secure locking device extending through said coaligned coupling and faceplate flange apertures to prevent said door from being opened, said secure locking device being inside said garage when deployed on said flange and coupling so there is no access to said secure locking device from outside of said garage.

2. The overhead door lock according to claim 1, wherein said mounting plate has a plurality of mounting apertures for mounting to said door header, said faceplate having at least one leg covering at least one of said apertures for preventing removal of said mounting plate when said locking device is in place.

3. The overhead door lock according to claim 2, wherein said mounting plate locking aperture and said first end of said coupling have mating threads.

4. The overhead door lock according to claim 3, wherein said legs of said faceplate are generally coplanar with said upwardly extending second leg of said bracket.

5. The overhead door lock according to claim 4, wherein said locking device is selected from a padlock and a pin.

6. An overhead door lock comprising:

a) a mounting plate having a plurality of mounting apertures mounted on an overhead door header inside of a garage and a threaded locking aperture;

b) a barricade having a bracket fastened to a top of an overhead sliding garage door and a coplanar faceplate affixed to said bracket, said faceplate having an aperture therethrough and a flange extending generally perpendicularly to said faceplate, said flange having an aperture therethrough, said bracket formed of a generally flat elongate structure with a generally right angle longitudinal bend forming a lower portion with a plurality of apertures for fastening to said top of said overhead door and an upper portion affixed to and generally coplanar with said faceplate;

c) a coupling passing through said faceplate aperture and having a first end with threads engaged said threaded mounting plate locking aperture and a second end having an aperture positioned such that when said first end of said coupling is inserted through said faceplate aperture and threaded into said threaded mounting plate locking aperture, said coupling aperture and said faceplate flange aperture are generally coaligned, when said garage door is closed; and d) a secure locking device inside of said garage extending through said coaligned coupling and faceplate flange apertures to prevent said door from being opened whereby there is no access to said secure locking device from outside of said garage.

7. The overhead door lock according to claim 6, in which said faceplate covers at least one mounting plate aperture to prevent said mounting plate from being removed when said secure locking device is in place.

8. The overhead door lock according to claim 7, wherein said locking device is selected from a padlock and a pin.

* * * * *